US006045202A

United States Patent [19]

Simon

[11] Patent Number: 6,045,202

[45] Date of Patent: Apr. 4, 2000

[54] JEWELERY BOX HAVING LINEARLY MOVABLE UPPER SECTION

[76] Inventor: Wolf Simon, 23440 Moon Shadows Dr., Malibu, Calif. 90265

[21] Appl. No.: 09/233,982

[22] Filed: Jan. 19, 1999

[51] Int. Cl.[7] ..... A47B 87/02

[52] U.S. Cl. ..... 312/107; 312/273; 312/301

[58] Field of Search ..... 312/107, 111, 312/273, 301, 308, 902; D3/903; 206/6.1, 315.11

[56] References Cited

U.S. PATENT DOCUMENTS

| | | | |
|---|---|---|---|
| 605,222 | 6/1898 | Gartner | 312/273 |
| 1,061,646 | 5/1913 | Welliver | 312/301 |
| 1,568,212 | 1/1926 | Cygan | 312/273 |
| 3,219,400 | 11/1965 | Bergquist | 312/107 |
| 3,318,648 | 5/1967 | Schonenbach | 312/273 |
| 3,939,982 | 2/1976 | Russell | 206/509 |
| 3,999,818 | 12/1976 | Schankler | 312/111 |
| 4,084,865 | 4/1978 | Joyce | 312/111 |
| 4,111,328 | 9/1978 | Eggert et al. . | |
| 4,203,525 | 5/1980 | Okubo . | |
| 4,405,057 | 9/1983 | Stein | 220/346 |
| 4,643,494 | 2/1987 | Marleau | 312/111 |
| 4,660,724 | 4/1987 | Gaynes | 206/509 |
| 4,710,853 | 12/1987 | Reinhardt | 361/391 |
| 4,782,619 | 11/1988 | Richards | 312/902 X |
| 5,082,115 | 1/1992 | Hutcheson | 206/545 |
| 5,205,429 | 4/1993 | Woolworth et al. | 312/301 X |
| 5,207,329 | 5/1993 | Hwang | 206/555 |
| 5,247,744 | 9/1993 | Ferris et al. . | |
| 5,261,529 | 11/1993 | Holland | 206/6.1 |
| 5,271,515 | 12/1993 | Berkheimer et al. | 220/4.27 |
| 5,277,307 | 1/1994 | Kelly | 206/45.14 |
| 5,383,552 | 1/1995 | Dikowitz | 206/6.1 |
| 5,469,961 | 11/1995 | Chang | 206/312 |
| 5,603,558 | 2/1997 | Zimmer | 312/290 |
| 5,782,372 | 7/1998 | Weiss | 220/8 |

FOREIGN PATENT DOCUMENTS

| | | | |
|---|---|---|---|
| 753969 | 3/1967 | Canada | 312/902 |

*Primary Examiner*—Peter M. Cuomo
*Assistant Examiner*—James O. Hansen
*Attorney, Agent, or Firm*—Cislo & Thomas LLP

[57] ABSTRACT

A unique jewelry box having at least an upper member and a lower member wherein the lower member has a compartment and wherein the first member is slidably and captively disposed relative to the second and lower member so that simple sliding movement of the upper member relative to the lower member achieves accessibility to the compartment contained within the lower member.

A simple guide and track system is utilized to achieve relatively trouble-free operation through a relatively simple low-cost mechanism.

11 Claims, 5 Drawing Sheets

FIG. 2
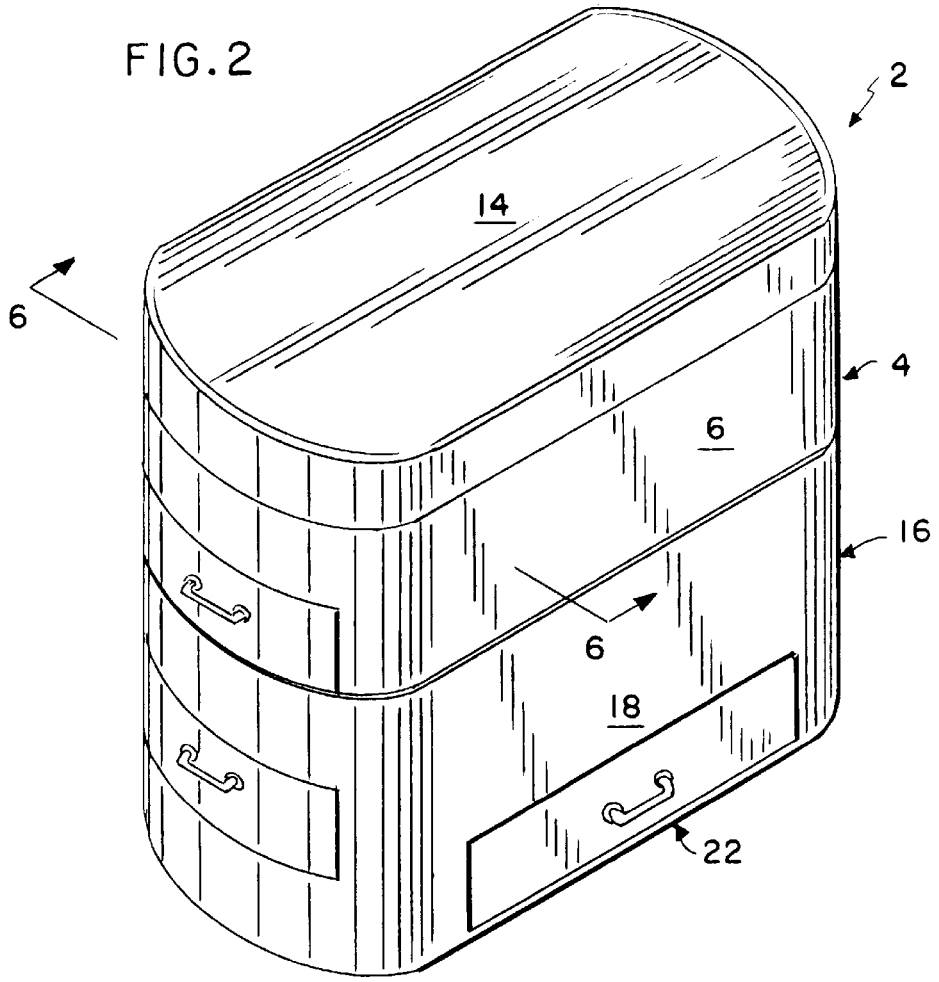
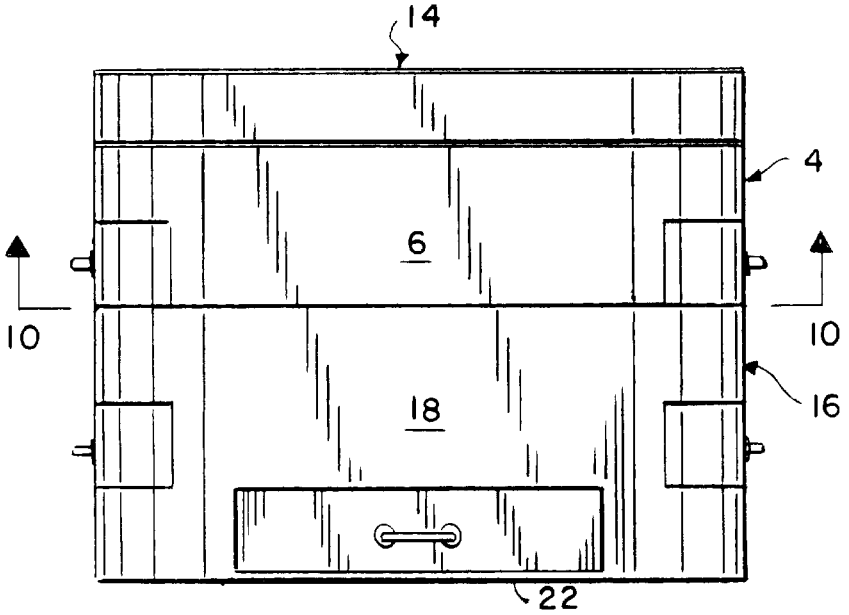
FIG. 3

FIG. 10
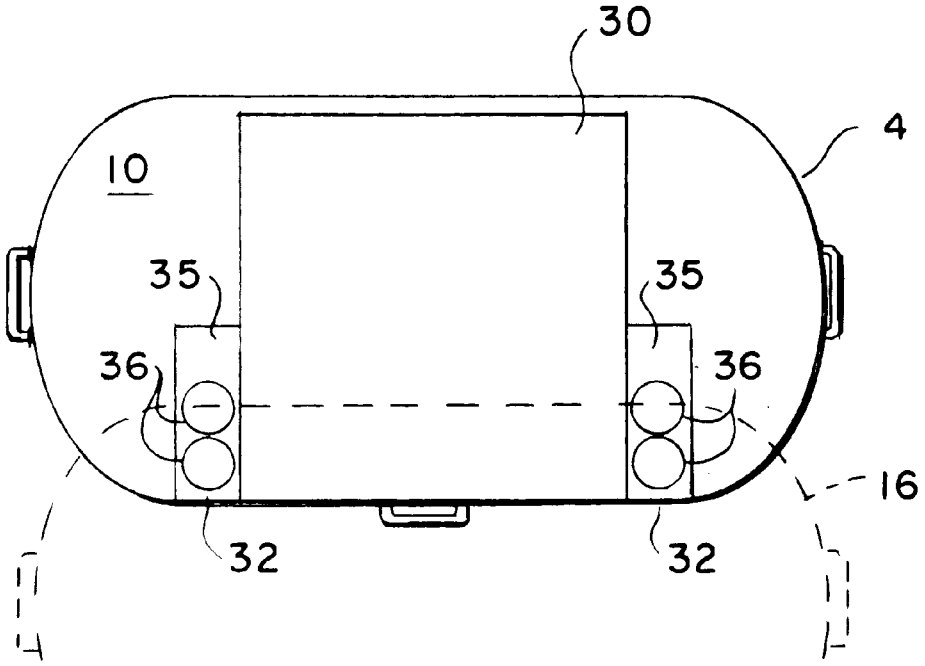
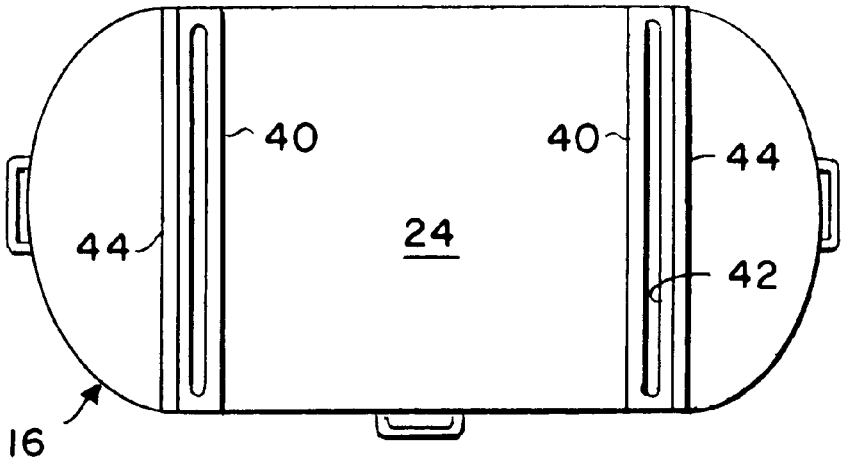
FIG. 11

JEWELERY BOX HAVING LINEARLY MOVABLE UPPER SECTION

BACKGROUND OF THE INVENTION

1. Field of the Invention

This invention relates to jewelry boxes and more specifically jewelry boxes of multitier construction wherein there is at least an upper member and a lower member which are moveable relative to each other so that ease of accessibility to a compartment within the lower member is easily achieved. The sliding feature of one member relative to the other is economically and almost mechanically fool proof in simplicity so as to be able to provide an easily manufactured, relatively low cost, easily accessible container that is unique in its construction.

2. Description of the Related Art

The ubiquitous jewelry box has been around for ages and has taken various forms. Generally, a single tier jewelry box has been known in the art which utilizes pull out drawers to provide a plurality of segregated compartments within which to store jewelry and the like.

As far as is known, there is no prior art that teaches a multi-tier jewelry box wherein an upper portion of the jewelry box is movable relative to a lower portion and wherein both the upper and the lower portions may be congruently configured in order to form a specific, combined polygonal shape once the upper and lower portions are in aligned relationship.

Further, no prior art is known wherein simple, spaced slotted tracks are operatively positioned with secured guide members to captively position an upper portion of the jewelry box relative to the lower portion of the jewelry box so that horizontal, linear movement of one portion relative to the other is obtained to provide ease of accessibility to the interior of the lower portion. Additionally, the relatively inexpensive, trouble-free mechanism of slotted track with an enlarged head button guide member provides trouble-free operation so as to expose the interior contents contained within the lower portion of a multi-tier jewelry box.

Ideally, the track and guide members are of low-coefficient of friction material to provide ease of sliding relationship relative to each other. To aid in this sliding relationship, a low-coefficient of friction, strips of material are placed adjacent to the slotted tracks and which have counterparts in the bottom surface of the upper portion adapted to slide thereon, which also aids in taking up any slack between the upper and lower portions and further as indicated, aids in slidability of each of the upper and lower members relative to each other.

However, a search of related prior art has been conducted and while no specific reference was found that would detract from the patentability of the herein disclosed multitiered jewelry box having the slide runner and guide relationship and nonetheless, the more pertinent references are discussed hereinbelow.

U.S. Pat. No. 5,271,515

This reference is directed to a multi-tiered display. As shown in the Drawings, the bottom surface 20 includes first, second, and third spaces 28, 30, and 32. The first space 28, or slot, is defined by the first projecting member 23 and a leading edge 34 of the second projecting member 24. Correspondingly, the top surface 22 includes three projecting members 48, 50, and 52. The first, second, and third projecting members 48, 50, and 52 are constructed so as to provide interlocking characteristics with the bottom surface 20 of the corresponding canister. To this end, the first projecting member 48 of the top surface 22 has a cross-sectional shape that is substantially similar to that of the first slot 28 on the bottom surface 20. To achieve mating, the first, second, and third projecting surfaces 48, 50, and 52 of a canister are slid into the respective spaces 28, 30, and 32 on the bottom surface 20 of another canister.

U.S. Pat. No. 5,782,372

This reference is directed to a collapsible carrying case. FIGS. 7 and 8 show a side view of the carrying case 7 in which the bottom module is the largest module while the top module is the smallest module. The carrying case 7 shown in open form, as shown in FIG. 7, and in closed form, shown in FIG. 8, comprises top module 70, intermediate modules 72, 74, and bottom module 76. The modules 70, 72, 74, 76 have drawer-like compartments 71, 75 with projections 73, 75 on the outside thereof to facilitate withdrawing of the drawer-like compartments from the modules.

U.S. Pat. No. 3,219,400

This reference is directed to a bookcase construction. The upper surface 60 of the top member 12 is provided with a pair of spaced parallel grooves 62, each groove comprised of a flat bottom portion 64 and a pair of upwardly extending inwardly tapering side portions 66. The bottom surface 68 on each bottom member 14 is provided with a pair of parallel extending tongue portions 70 which are shaped so as to be slidably received in the grooves 62. Consequently, two sections 10 can be superposed upon one another as shown in FIG. 1, with the tongues 70 on the bottom surface of the bottom member of the upper section being slidably received in the groove portions 62 defined in the upper surface of the top members of the lower section.

U.S. Pat. No. 3,999,818

This reference is directed to a modular storage system. Disposed on the exterior surface of the top section 12 of the holder 10 is a raised rectangular shaped flattened projection 24 having a dovetail cross-section. A rectangular shaped recess 25 having a dovetail cross-section corresponding to the shape of projection 24 is disposed in the exterior surface of the bottom section of the holder 10. Thus, the top section 12 of one of the holders 10 may be interlocked with the bottom section 13 of a similar holder by engaging the projection 24 with the recess 25. A forward lip 26 adjacent the recess 25 acts as a stop means, to insure proper alignment of the open front portions 16 of the holders when they are so interlocked.

U.S. Pat. No. 4,203,525

This reference is directed to a vaulting box. As shown in the Drawings, the vault box comprises basically a lower pyramid-shaped frame member 1 and an upper pyramid shaped frame member 2. If desired, one or more intermediate frame members 4 of similar truncated pyramid shape may also be provided. The bottom frame member 1 is provided with a bottom closure plate la which is adapted to slide through a slot 5 formed in one end wall and through longitudinal grooves 6 formed in the side walls. The intermediate frames 4, when employed, are similarly constructed to the bottom member 1 having an upwardly extending flange **4*b* at each end and continuous upper and lower perimetal edges so that they can be stacked, in secure assembly. Each of the intermediate members is provided with a slot 5, capable of receiving a slidable plate 4*a*, similar to that of the bottom plate 1*a***.

U.S. Pat. No. 4,643,494

This reference is directed to an interlocking box, wherein the box has no frame and may have as many horizontally sliding trays as desired. This reference is directed to the ubiquitous fishing tackle-type box, although, it may also have uses as a jewelry box as disclosed at column 1 of the patent. Note that the upper top 12 is slidably engaged to the tray section 32 by means of end slide and groove members to allow movement of the upper section in reference to the lower section of the interlocking box, as best seen in FIGS. 3 and 4.

DISCLOSURE OF THE INVENTION

In its simplest terms, the invention is directed to a multi-tier jewelry box comprising the combination of at least a first member having side and bottom walls and being adapted to fit in an aligned superposition relationship, and being linearly movable along a captive path, relative to a lower member. The lower member has an open top and defines a compartment and further has spaced horizontal slotted rail members in opposition to the bottom wall of the first upper member and wherein the slotted rail members extend along one dimension, generally the width of the lower member and wherein the upper member has opposed guide members secured to the bottom wall thereof which are captively retained within the slots of the spaced horizontal slide rail members whereby the upper member is selectively, linearly and slidably movable relative to the lower member to open and close the interior, or compartment of the lower member to accessibility.

It is an object of the present invention to provide a multi-tiered jewelry box wherein one component of the tier is slidably movable relative to the other and movement thereof is permits accessibility to the lower positioned member of the tier.

It is another even more important specific object of the invention to provide a jewelry box wherein there is at least one upper member that is slidably disposed with respect to a congruently shaped lower member and wherein slidability is obtained through a simple guide and track arrangement.

It is another more important object of the invention to provide a multi-tiered jewelry box wherein at least two of the members making up the tier are slidably disposed relative to each other through a simple slide track and guide relationship.

It is still another even more important object of the invention to provide a jewelry box having an upper portion and a lower portion, the upper portion being slidably disposed through a track and guide relationship relative to the lower portion and wherein the jewelry box is economically manufactured and is essentially trouble-free in operation.

It is still another even more specific and important object of the invention to provide a jewelry box having an upper portion that is slidably disposed with respect to a lower portion such that the upper portion is captively and linearly slidable relative to the lower portion and which may be selectively positioned in a fully closed and aligned position or may be positioned in a fully open position to allow access to the interior of the lower positioned member.

These and other objects of the invention will become apparent when referring to the hereinafter following commentary taken in conjunction with the drawings.

BRIEF DESCRIPTION OF THE DRAWINGS

FIG. 2 is a perspective view of the FIG. 1 jewelry box having all compartments and drawers in the closed position;

FIG. 3 is a front view of the jewelry box shown in FIG. 2;

FIG. 10 is a view taken along the line 10—10 of FIG. 3; and

FIG. 11 is a view taken along the line 11—11 of FIG. 4.

DESCRIPTION OF THE PREFERRED EMBODIMENT(S)

Figure 1:
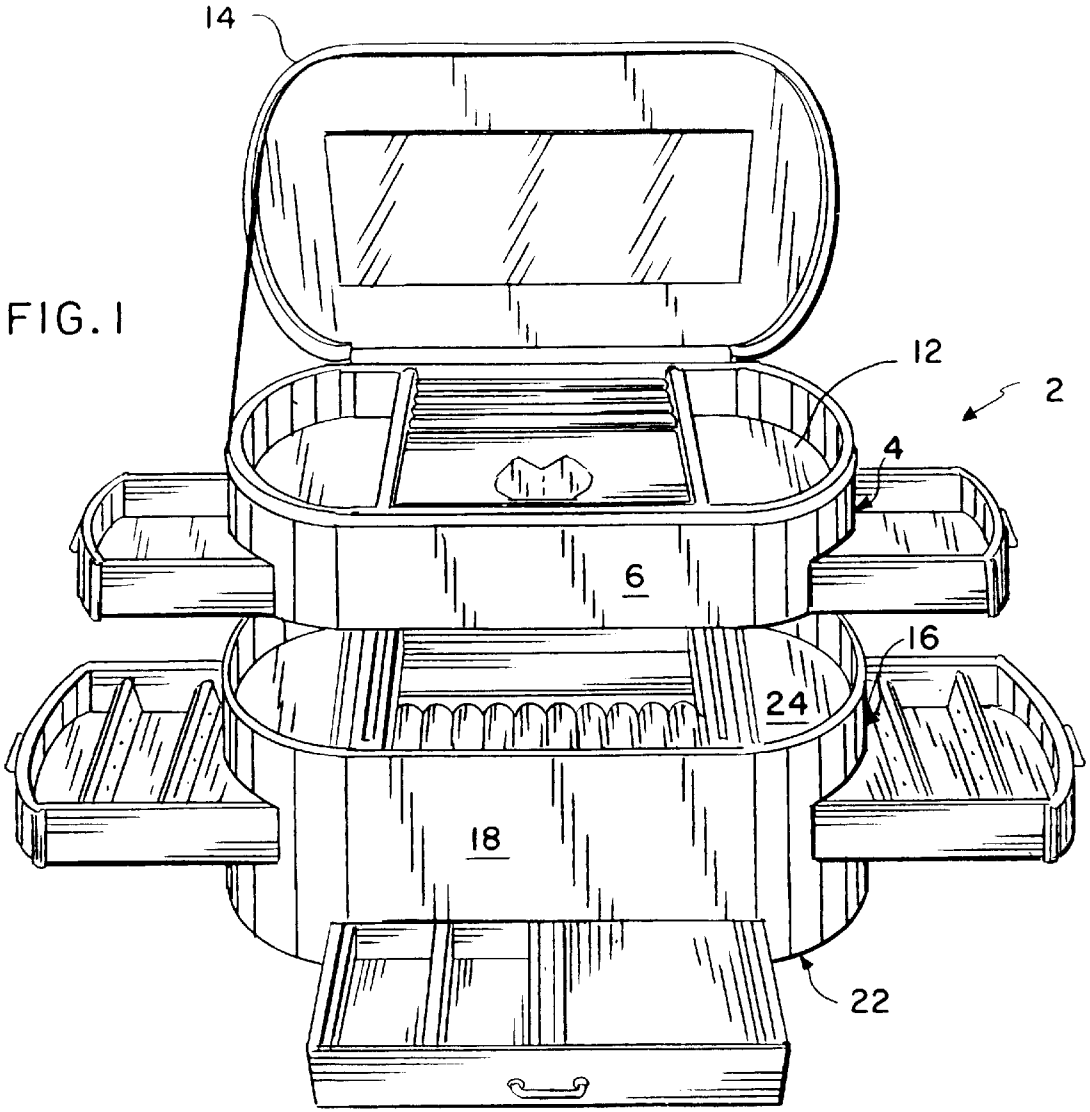
FIG. 1 is a perspective view of the unique jewelry box of this invention with various compartments and drawers being shown in the open position.
Figure 4:
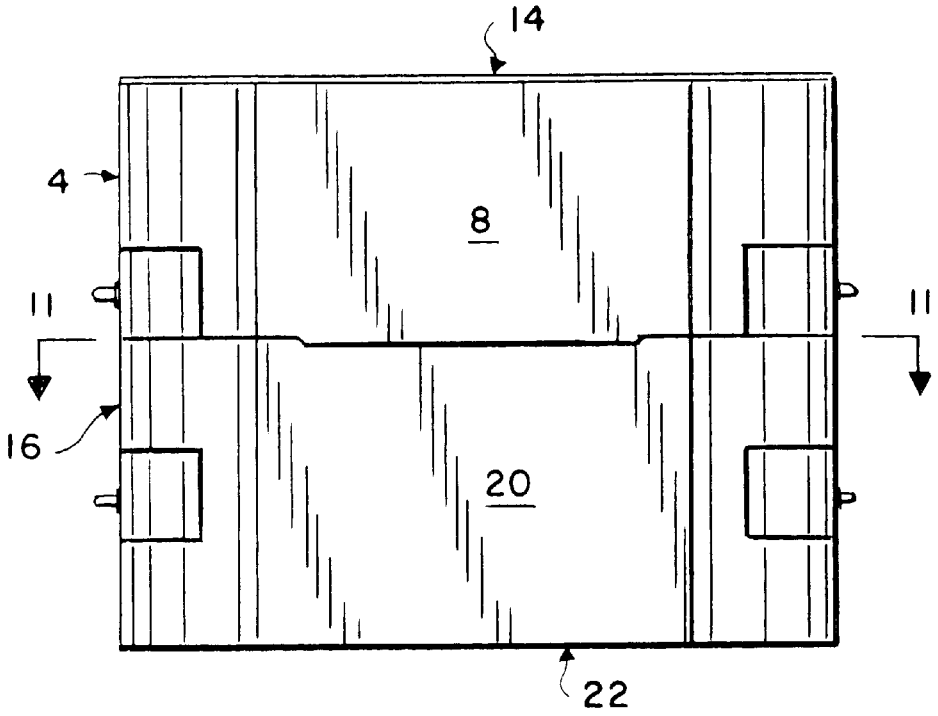
FIG. 4 is a rear view of the jewelry box shown in FIG. 2.
Figure 5:
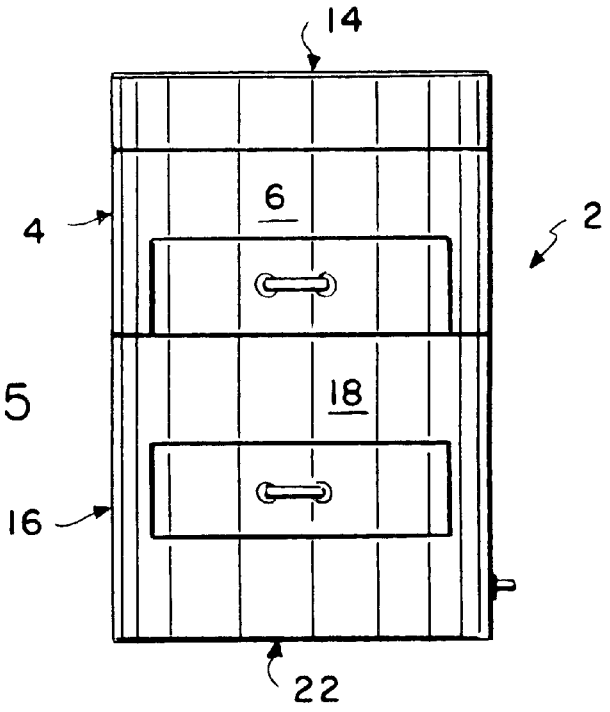
FIG. 5 is a side view of the jewelry box shown in FIG. 2.

The detailed description set forth below in connection with the appended drawings is intended as a description of presently preferred embodiments of the invention and is not intended to represent the only forms in which the present invention may be constructed and/or utilized. The description sets forth specific elements of structure, but is not to be limited to those specific illustrations.

For example, while the drawings show that the slided tracks are disposed on the upper portion of the lower member, the track and guide relationship may be reversed and still achieve the same desired end results.

Indeed, the appended claims are intended to encompass these various modifications and changes, all of which will make themselves readily apparent to those of ordinary skill in the art, all without departing from the spirit and scope of the invention.

Thus, while the present invention is described with regard to particular embodiments, it should be recognized that additional variations of the present invention may be devised without departing from the inventive concept.

In referring to the drawings wherein like numerals of reference designate like elements throughout, it will be seen that the jewelry box 2 of the invention is multi-tiered, that is, has more than one compartment or segment, and in this particular instance, there is an upper member 4 having side walls 6 and 8 with a bottom wall 10 thereby defining an interior space 12 with hinged cover 14 completing the structure.

Positioned below upper member 4 is lower member 16 having side walls 18 and 20 with bottom wall 22 thereby defining an interior space or compartment 24.

It should be noted that upper member 4 and lower member 16 may be provided with one or more pull out drawers which form no part of the invention and are commonplace in the ubiquitous jewelry boxes that have long been in the prior art. Likewise, the interior spaces or compartments 12 and 24 may be segregated with various partitions, ring receiving portions and other partitioning sections and cushions, also long known in the prior art and also not forming any part of the invention.

Secured to bottom wall 10 of upper portion 4 is reinforcing plate 30 of a dimension to fit, as will be seen, within the space between two track members 40, as will be described, and thus, to form a snug fit between upper member 4 and lower member 16 when in aligned relationship, making up jewelry box 2.

As best seen in FIG. 10, secured to bottom wall 10 of member 4 are spaced guide members 32, in this particular instance, taking a configuration as a stub-shaft 34 having enlarged heads 36 for purposes that will be described (also see FIGS. 6 and 7). Reinforcing strips 35 of low coefficient of friction material may be placed adjacent either side of reinforcement panel 30, as best seen in FIG. 10, to give structural strength to that bottom portion of wall 10 where the guide members 32 are secured. Additionally, because of the slippery nature of the strips 36, the same provide ease of movement when upper member 4 is moved relative to lower member 16 as seen in FIGS. 8 and 9 of the drawings and as will be further described.

Figure 6:
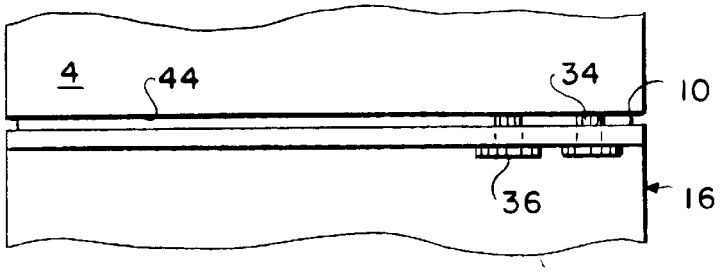
FIG. 6 is a view taken along the line 6—6 of FIG. 2.
Figure 7:
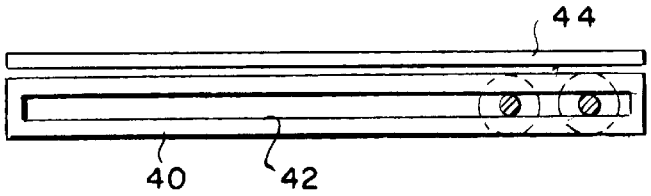
FIG. 7 is an enlarged, fragmented view showing, in more detail, the runner or track construction used in the jewelry box of the invention.

Referring to FIG. 11, it will be noted that lower member 16 at the upper edge thereof is provided with spaced track members 40, in this particular instance, taking a rectangular configuration with a central elongated slot 42 (also see FIG. 7) so as to captively retain the enlarged heads 36 of guide members 32, as best seen in FIGS. 6 and 7 of the drawings. In this particular instance, the slotted slide or track members 40 are of low coefficient of friction material. It has been found that brass or one of the plated materials do very well in the application intended. However, other low-coefficient of friction materials such as plastics or the like may be utilized.

Further, referring to FIG. 11, there is positioned adjacent each of the slotted slide or track members 40 a partition member 44 adjacent each of the slide tracks 40 as best seen in FIGS. 1 and 11, and being slightly upraised (FIG. 8) to allow additional sliding support and better fit when upper member 4 is moved relative to lower member 16 (FIG. 9) and when in aligned relationship in order to obtain the snug fit so that the jewelry box 2 has a somewhat rigid feel to it (FIGS. 2, 3 and 6).

Figure 8:
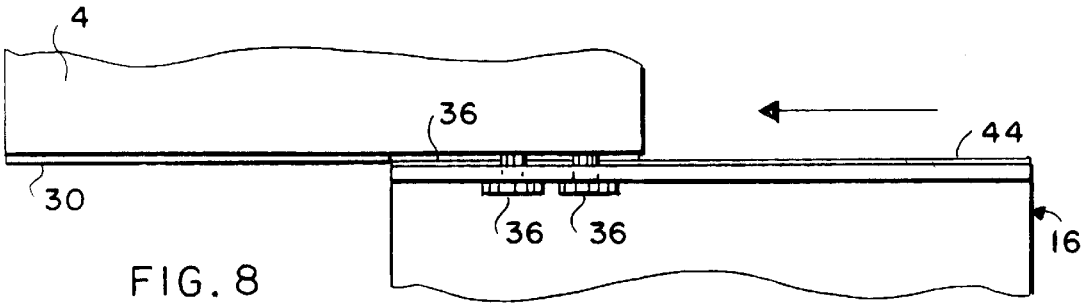
FIG. 8 is a partial, fragmented view showing horizontal linear movement of the upper portion of the jewelry box relative to the lower portion of the jewelry box, as depicted in the direction of the arrow.
Figure 9:
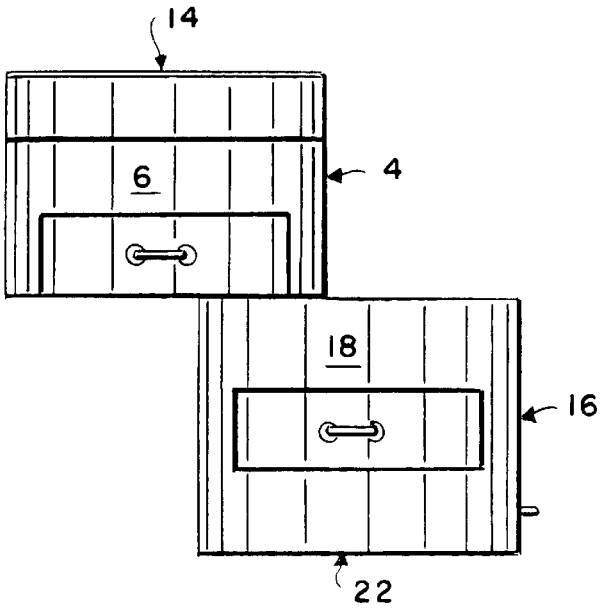
FIG. 9 is a side view showing the upper portion of the jewelry box fully extended along the path of travel to permit accessibility to the open compartment of the lower portion, comprising the jewelry box of the invention.

In use, it is clear that when the jewelry box 2 is in the configuration shown in FIG. 2, that one may gain rapid and easy access to the upper compartment 12 of member 4 merely by pushing in the direction of the arrow seen in FIG. 8 with either one hand or two hands, and that after accessibility is achieved, one may merely slide member 4 back into superposition with respect to member 4, as shown in the drawings.

Thus, there has been described a uniquely configured jewelry box which has an easily accessible compartment, which accessibility is achieved by sliding the upper member relative to the lower member and wherein, this accessibility is achieved through a mechanism that is simple in construction and relatively free from mechanical breakdown in that a simple track and guide system is utilized in order to allow captive retention of the upper member relative to the lower member, while still providing relative movement therebetween.

While the invention has been described with for example and upper member 4 and a lower member 16, it is clear that a plurality of members may be utilized, all without detracking from the spirit of the invention. Various modifications and changes may be made all without deviating form the essence of the invention with respect to securement of one member to another, wherein that securement is through a sliding mechanism to achieve quick and easy accessibility to the interior compartment of one of the members.

While the invention has been described with respect to specific configuration and the use of specific descriptive materials, those of ordinary skill in the art will, of course, recognize that various changes and modifications may be made. For example, in some instances, a singular guide member 32 may be utilized or one of different shape, it only being important that it cooperate structurally with a slide member to captively retain and allow movement of one member relative to the other.

The materials of construction for the jewelry boxes of the instant invention may be these commonly employed in such constructions such as wood, plastic, lacquered or reinforced cardboard and the like held together by rods, screws, nails and/or glue. Exterior coverings may comprise plastics to leather.

All such changes and modifications are intended to be covered by the appended claims.

What is claimed is:

1. A multi-tier jewelry box comprising an upper member having side and bottom walls and being adapted to fit in aligned superposition relation and being linearly movable along a captive path, relative to a lower member and form a closure therefor;

a lower member having an open top and defining a compartment and having spaced horizontal, slotted rail members located within said compartment and mounted even with an upper edge of said lower member, said rail members being adjacent and flush to said bottom wall of said first upper member when said upper member is superimposed over said lower member;

said upper member having opposed guide members secured to said bottom wall thereof and being captively retained within said adjacent, spaced, horizontal slotted rail members whereby said upper member is selectively linearly and slidably movable relative to said lower member to open and close said compartment to accessibility.

2. The jewelry box in accordance to with claim 1 wherein said slotted rail members are of low-coefficient of friction material.

3. The jewelry box in accordance with claim 2 wherein said guide members comprise enlarged head studs each having shanks and enlarged heads with the shank of each stud extending through the slotted rail member and said enlarged head being larger in diameter than the slot of said slotted members.

4. The jewelry box in accordance with claim 2 wherein said guide members are of low-coefficient of friction material.

5. The jewelry box in accordance with claim 4 wherein said lower member has spaced lateral supports extending the width thereof.

6. The jewelry box in accordance with claim 5 wherein said slotted rail members are mounted on said spaced lateral supports.

7. The jewelry box in accordance with claim 6 wherein guide runners are positioned adjacent each of said slotted rail members in order to aid in the sliding movement of said upper member relative to said lower member.

8. A multi-tier jewelry box comprising at least an upper member having side and bottom walls and being adapted to fit in aligned superposition relation and being linearly movable along a captive path, relative to a lower member and adapted to form a closure therefor;

at least a lower member congruently shaped to said upper member having an open top and defining a compartment and having a pair of spaced horizontal, slotted rail members operatively supported in a plane parallel and adjacent to said bottom wall of said first a upper member and extending the width thereof and located within said compartment and mounted even with an upper edge of said lower member, said rail members being adjacent and flush to said bottom wall of said first upper member when said upper member is superimposed over said lower member;

said upper member having at least two opposed guide members secured to said bottom wall thereof and each being captively retained within the slot of each of said pair of slotted rail members, said guide members having an enlarged head having a diameter larger than the width of said slot of each of said pair of slotted rail members whereby said upper member is selectively linearly and slidably movable relative to said lower member to open and close said compartment to accessibility and to position said upper and lower members in aligned relationship.

9. A multi-tier jewelry box comprising:

an upper member having side and bottom walls and being adapted to fit in aligned superposition relation and being linearly movable along a captive path, relative to a lower member;

a lower member having an open top and defining a compartment and having spaced lateral supports extending the width thereof and having spaced horizontal, slotted rail members of low-coefficient of friction material adjacent to said bottom wall of said first upper member and extending along one dimension thereof and being mounted on the upper surface of said spaced lateral supports;

said upper member having opposed guide members of low-coefficient of friction material secured to said bottom wall thereof and being captively retained within said adjacent, spaced, horizontal slotted rail members and guide runners are positioned adjacent each of said slotted rail members in order to aid in the sliding movement of said upper member relative to said lower member whereby said upper member is selectively linearly and slidably movable relative to said lower member to open and close said compartment to accessibility.

10. The jewelry box in accordance with claim 9 wherein the bottom wall of said upper member is provided with spaced, reinforced portions at least adjacent each of said guide members and which are adapted to aid in sliding movement of said upper member relative to said lower member.

11. The jewelry box in accordance with claim 10 wherein the bottom wall of said upper member has a central reinforcing panel which is adapted to extend over and slightly depend into said compartment of said lower member in order to provide a snug fit between said first upper and said second lower member when in aligned, closed relationship with each other.

* * * * *